US012180803B2

(12) United States Patent
Saraya et al.

(10) Patent No.: US 12,180,803 B2
(45) **Date of Patent: *Dec. 31, 2024**

(54) METHODS AND SYSTEMS FOR A FRAC PLUG

(71) Applicant: Vertice Oil Tools, Inc., Stafford, TX (US)

(72) Inventors: Mohamed Saraya, Sugar Land, TX (US); Stephen Parks, Houston, TX (US); Mike Lo, Houston, TX (US)

(73) Assignee: Vertice Oil Tools, Inc., Stafford, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/510,282

(22) Filed: Nov. 15, 2023

(65) Prior Publication Data

US 2024/0093569 A1 Mar. 21, 2024

Related U.S. Application Data

(63) Continuation of application No. 18/105,851, filed on Feb. 5, 2023, now Pat. No. 11,851,975, which is a continuation of application No. 18/083,662, filed on Dec. 19, 2022, now Pat. No. 11,661,814, which is a continuation of application No. PCT/US2022/035448, filed on Jun. 29, 2022.

(51) Int. Cl.

| | |
|---|---|
| ***E21B 33/129*** | (2006.01) |
| ***E21B 33/128*** | (2006.01) |
| ***E21B 43/26*** | (2006.01) |

(52) U.S. Cl.
CPC ..... *E21B 33/129* (2013.01); *E21B 33/128* (2013.01); *E21B 43/26* (2013.01)

(58) Field of Classification Search
CPC .. E21B 33/1208; E21B 33/128; E21B 33/129; E21B 33/1293; E21B 33/134; E21B 34/063; E21B 43/26
See application file for complete search history.

(56) References Cited

U.S. PATENT DOCUMENTS

| | | | | |
|---|---|---|---|---|
| 6,167,963 | B1 * | 1/2001 | McMahan | E21B 33/1216 166/134 |
| 8,770,276 | B1 * | 7/2014 | Nish | E21B 33/1291 166/138 |
| 9,157,288 | B2 * | 10/2015 | Martinez | E21B 23/01 |
| 9,518,442 | B2 * | 12/2016 | Xu | E21B 33/134 |
| 10,024,134 | B2 * | 7/2018 | Webster | E21B 33/1293 |
| 10,612,339 | B2 * | 4/2020 | Murphy | E21B 33/1216 |
| 10,851,614 | B2 * | 12/2020 | Kellner | E21B 33/1291 |
| 11,142,975 | B2 * | 10/2021 | Hayward | E21B 33/129 |

(Continued)

FOREIGN PATENT DOCUMENTS

WO WO-2022093756 A1 * 5/2022 ..... E21B 33/134

*Primary Examiner* — Daniel P Stephenson
(74) *Attorney, Agent, or Firm* — Pierson IP, PLLC

(57) ABSTRACT

A frac plug with lower slips and a lower cone. In embodiments, a lower cone ramp angle is greater than or equal to a cone bevel angle and a slip inner cut angle. This geometry enables the fins of the cone to not interact with the lower slips, which may not break the lower slips as the lower slips move over the cone. Instead, the lower slips may break due to stresses caused by the tendency of the lower slips to expand as they lower slips interact with the ramp of the lower cone.

19 Claims, 7 Drawing Sheets

(56) References Cited

U.S. PATENT DOCUMENTS

| | | | | |
|---|---|---|---|---|
| 11,578,555 | B2 * | 2/2023 | Saraya | E21B 33/129 |
| 11,851,975 | B1 * | 12/2023 | Saraya | E21B 23/01 |
| 2014/0020911 | A1 * | 1/2014 | Martinez | E21B 33/129 166/134 |
| 2014/0262344 | A1 * | 9/2014 | Standridge | E21B 33/129 166/208 |
| 2015/0027737 | A1 * | 1/2015 | Rochen | E21B 23/01 166/138 |
| 2016/0305215 | A1 * | 10/2016 | Harris | E21B 33/1291 |
| 2017/0101835 | A1 * | 4/2017 | Webster | E21B 33/1293 |
| 2017/0101836 | A1 * | 4/2017 | Webster | E21B 33/1293 |
| 2018/0179850 | A1 * | 6/2018 | Hou | C08K 3/346 |
| 2018/0245422 | A1 * | 8/2018 | Fripp | E21B 33/12 |
| 2019/0063178 | A1 * | 2/2019 | Frazier | E21B 33/12 |
| 2019/0292874 | A1 * | 9/2019 | Saeed | E21B 33/1293 |
| 2022/0090464 | A1 * | 3/2022 | Berryman | E21B 33/128 |
| 2023/0392469 | A1 * | 12/2023 | Molzahn | E21B 33/129 |
| 2024/0093569 | A1 * | 3/2024 | Saraya | E21B 33/129 |

* cited by examiner

METHODS AND SYSTEMS FOR A FRAC PLUG

BACKGROUND INFORMATION

Field of the Disclosure

Examples of the present disclosure relate to a downhole tools. More specifically, embodiments are related to a frac plug with lower slips and a lower cone. In embodiments, a lower cone ramp angle may greater than or equal to a cone bevel angle and a slip inner cut angle. This geometry enables the fins of the cone to not interact with the lower slips, which may not shear the lower slips as the lower slips move over the cone. Instead, the lower slips may break due to stresses caused by the tendency of the lower slips to expand as the lower slips interact with the ramp of the lower cone.

Background

Conventionally, after cementing a well and to achieve Frac/zonal isolation for a Frac operation, a frac plug and perforations on a wireline are pushed downhole to a desired a depth. Then, a frac plug is set and perforation guns are fired above to create conduit to frac fluid. This enables the fracing fluid to be pumped. Typically, to aid in allowing the assembly of perforation and frac plug to reach the desired depth, specifically in horizontal or deviated laterals, pumping operation can be used. During the pumping operation the wireline is pumped down hole with the aid of flowing fluid.

These conventional frac plugs are held in place via slips and packing elements. Conventional slips, cones, and packing elements are loaded on an outer mandrel on the frac plug. Conventional cones may include fins that interface with an upper notch and webbing of a slip, this may provide more uniform slips breaking points creating a consistent gap between each slips after breakage. However, due to the angularity of conventional fins, distal ends of the conventional fins contact a proximal face of the webbing. This may cause the lower slips to shear pre-maturely instead of expanding outwards then shearing.

Accordingly, needs exist for systems and methods utilizing a frac plug, wherein a lower cone ramp angle is greater than or equal to a cone bevel angle and a slip inner cut angle. The relative geometry of elements of the lower cone and lower slips enables the fins of the cone to not interact with the lower slips, which may not break the lower slips as the lower slips move over the cone. Instead, the lower slips may break due to stresses caused by the tendency of the lower slips to expand as the lower slips interact with the ramp of the lower cone.

SUMMARY

Embodiments disclosed herein describe systems and methods for a frac plug. The frac plug may include a lower cone a lower slips. The frac plug may also include other elements that may be sequentially loaded on a mandrel of the frac plug. For example, the frac plug may also include a load ring, upper slips, upper cone, and a packer.

The lower slips may be positioned adjacent to the lower cone and the cap. The lower slips may be a device that is used to grip and hold frac plug against the casing internal diameter. The lower slips may be configured to radially expand or break based on the relative movement with the lower cone. The lower slips may include a plurality of wedges that are formed in a near circle around the mandrel.

After the lower slips are deployed and radially expanded, pairs of the wedges may be retained together. In embodiments, the lower slips may include an inner surface and webbing. The inner surface may have a first angle, and be configured to interface with a ramp of the lower cone. Responsive to the inner surface of the wedges interfacing with the ramp, the lower slip may radially expand.

The webbing may have an inner surface that has a slip inner cut angle that is substantially the same as the first angle of the ramp of the lower cone and a cone bevel angle of a fin. In embodiments, due to the relative geometries of the inner surface of the webbing and the cone bevel angle of the fin, the inner surface of the webbing may not touch, intersect, or contact an outer surface of the fin. By eliminating the contact between the webbing and the fins, a failure point of the lower slip may be removed. Furthermore, the slip inner cut angle may increase the thickness of the webbing at a location that is further away from the distal end of the fin, which may also decrease the likelihood of wedges of the slips breaking apart from each other.

The cone may be positioned between the packing element and the lower slips. The cone may be configured to slide towards the cap of the frac plug to radially expand the lower slips. The cone may include a ramp and fins. The ramp may be configured to interface with the inner surface of the wedges to radially expand the lower slips. The ramp may have a lower cone ramp angle that can be any realistic angle for a lower cone, such as between 5 and 30 degrees. In embodiments, the first angle may be substantially the same as the lower cone ramp angle, which may assist in radially expanding the lower slips.

The fins may be configured to be positioned within the upper notches of the webbing when run in hole, and under the webbing of the lower slips when the lower slips are activated. The fins may have a cone bevel angle that may be substantially equal to or less than the lower cone ramp angle, wherein the cone bevel angle is equal to that of the slip inner cut angle. However, In other embodiments, the cone bevel angle may be slightly greater than the lower cone ramp angle. For example, the cone bevel angle may be ten degrees larger than the lower cone ramp angle. In embodiments, the outer surface of the fins and the inner surface of the webbing may be offset from each other when run in hole, and both positioned away from an outer diameter of the mandrel. Due the equal angling of the outer surface of the fins and the inner surface of the webbing, the two may not contact each other even after the cone moves towards the cap and the lower slips are activated. This may enable the wedges of the lower slips to not break due to the fins interacting with the webbing. However, the wedges may break due to hoop stresses caused by the wedges expanding as they move over the ramp of the cone.

Furthermore, in embodiments, even if the outer surface of the fin was to interact with the lower surface of the webbing, a fin would not initially contact an edge of the webbing. This would merely assist in radially expanding the webbing rather than shearing the webbing.

The cap may be positioned on a distal end of the frac plug. The cap includes a passageway, recess, and projection. The passageway may be an opening extending through the inner diameter of the cap from a proximal end to a distal end of the cap, which allows fluid to flow through the inner diameter of the frac plug. The recess may a groove, depression, etc. be positioned on the distal end of the cap, wherein the recess is cylindrical in shape. The projection may extend away from the lip in a direction along the longitudinal axis of the frac plug. The projection may have an inner diameter that is greater than that of the passageway and smaller than an outer diameter of the recess. The projection may be configured to receive a frac ball, object, etc., such that if the frac ball is positioned on the projection there is communication through passageway via the space between the frac ball and the recess.

In embodiments, the cap and the lower slips may form an anti-rotation mechanism. The anti-rotation mechanism may be configured to allow relative linear movement between the cap and the lower slips but restrict relative rotational movement between the cap and the groove. The anti-rotation mechanism may include projections positioned on a distal end of the lower slips and grooves positioned on a proximal end of the cap. In alternative embodiments, the projections may be positioned on a proximal end of the cap, and the grooves may be positioned on the distal end of the lower slips.

Embodiments may include a flapper with a weak point, wherein the flapper is configured to rotate from a position blocking an inner diameter of the frac plug to a position allowing fluid to flow around the flapper. The flapper may be mounted inside the mandrel of the frac plug. The flapper may include a removable weak point assembly that is configured to form a passageway responsive to removing the removable weak point assembly, wherein the weak point assembly extends from an upper surface of the flapper to a lower surface of the flapper. In embodiments, the flapper may be positioned closer to a proximal end of the frac plug than the load ring. By position the flapper above the elements of the frac plug, the flapper may restrict the flow of fluid through the mandrel, which may limit pre-mature setting of the frac plug.

These, and other, aspects of the invention will be better appreciated and understood when considered in conjunction with the following description and the accompanying drawings. The following description, while indicating various embodiments of the invention and numerous specific details thereof, is given by way of illustration and not of limitation. Many substitutions, modifications, additions or rearrangements may be made within the scope of the invention, and the invention includes all such substitutions, modifications, additions or rearrangements.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

Figure 1:
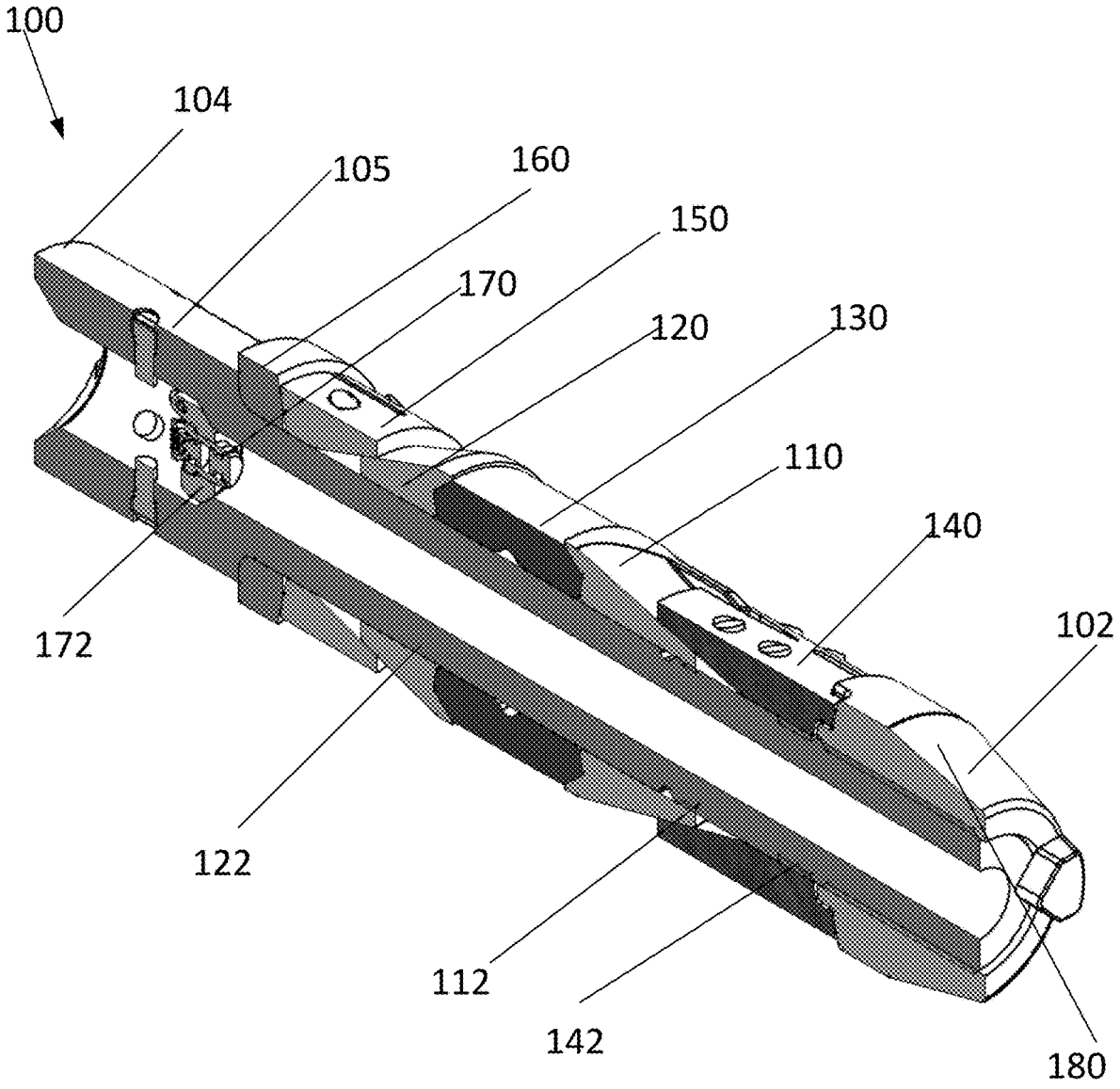
FIG. 1 depicts a downhole tool, according to an embodiment.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help improve understanding of various embodiments of the present disclosure. Also, common but well-understood elements that are useful or necessary in a commercially feasible embodiment are often not depicted in order to facilitate a less obstructed view of these various embodiments of the present disclosure.

DETAILED DESCRIPTION

In the following description, numerous specific details are set forth in order to provide a thorough understanding of the present invention. It will be apparent, however, to one having ordinary skill in the art that the specific detail need not be employed to practice the present invention. In other instances, well-known materials or methods have not been described in detail in order to avoid obscuring the present invention.

FIG. 1 depicts a downhole tool 100, according to an embodiment. Downhole tool 100 may be a frac plug, which may be configured to isolate a stage in a cased hole after cementing. Downhole tool 100 may enable perforating and treating each stage optimally and selectively, wherein downhole tool 100 is pumped down to a desired depth, set, the zone above may be perforated. In embodiments, downhole tool 100 may be a frac plug that is formed of any material, or a combination of materials. Downhole tool 100 may include a mandrel 105, lower cone 110, upper cone 120, packing element 130, lower slips 140, upper slips 150, load ring 160, flapper 172, and cap 180.

Lower cone 110 may be positioned between packing element 130 and lower slips 140. Lower cone 110 may be configured to engage with lower slips 140 to radially expand or break the lower slips 140. In embodiments, lower cone 110 may be coupled to the mandrel 105 via threads 112 or other any other coupling method. Threads 112 may be positioned on an outer circumference of mandrel 105, and may allow lower cone 110 to be coupled to mandrel 105. The coupling of lower cone 110 and mandrel 105 may limit the longitudinal movement of lower cone 110 while downhole tool 100 is being run in hole. Specifically, threads 112 may not allow lower cone 110 to move to interface with lower slips 140 prematurely before an operation is used to activate downhole tool 100. As such, incidental pressure changes from fluid flowing around lower cone 110 while downhole tool 100 is being pumped downhole may not be sufficient to substantially move lower cone 110 to set lower slips 140. Responsive to performing an operation to set downhole tool 100, such as operating a setting tool, the forces applied against threads 112 may be sufficient enough to break the coupling point, which may allow lower cone 110 to move downhole and slide under lower slips 140, which may radially expand lower slips 140.

Upper cone 120 may be positioned between the upper slips 150 and packing element 130. Upper cone 120 may be configured to engage with upper slips 150. When upper cone 120 engages with upper slips 150, upper slips 150 may radially expand. In embodiments, the upper cone may be coupled to the mandrel 105 via threads 112 or any coupling mechanism, such as pins. Threads 112 may allow upper cone 120 to be coupled to mandrel 105, which may limit the longitudinal movement of upper cone 120 while downhole tool 100 is being run in hole. In other embodiments, the threads 112 can be any coupling point including a pin that couple the upper slips 150 to the cone 120 and mandrel 122. Specifically, coupling point 122 may not allow upper cone 120 to move to interface with upper slips 150 or packing element 130 prematurely before an operation is used to activate downhole tool 100. As such, incidental pressure changes from fluid flowing around upper cone 120 while downhole tool 100 is being pumped downhole may not be sufficient to substantially move upper cone 120 to set upper slips 120. Responsive to performing an operation to set downhole tool 100, such as operating the setting tool, the forces applied against coupling point 122 may be sufficient enough to break the coupling point, which may allow upper cone 120 to move. Furthermore, upper cone 120 may be configured to allow upper slips 150 to slide over upper cone 120 to radially expand upper slips 150.

Packing element 130 may be an elastomeric packing element that is configured to radially expand and seal across the annulus based on a pressure differential. An elasticity of packing element 130 may be based upon the cross sectional thickness of sealing element, which may be controlled based on the profiles of the inner diameter and outer diameter of packing element 130. Outer diameter of packing element 130 may have a concave curvature, which increases a thickness of sealing element 150 towards the ends of the longitudinal axis of packing element 130. By varying the thickness of the packing element 130, cross-sectional areas of the packing element 130 may be varied. This may change a pressure differential applied to the packing element 130 at different cross sectional areas. Accordingly, as fluid is pumped within the annulus between the outer surface of the packer and casing, the curvature of the outer surface may control or create a Bernoulli Effect and the pressure differential across the Packing element 130 at different locations. As such, packing element 130 may not deploy prematurely. In embodiments, packing element 130 may be positioned between lower cone 110 and upper cone 120, and may be configured to radially expand responsive to a distance between lower cone 110 and upper cone 120 decreasing, which may occur after threads 112 and 142 are broken.

Lower slips 140 and upper slips 150 may be configured to radially move outward and expand across an annulus to secure mandrel 105 to a casing, wherein the annulus is positioned between an outer diameter of mandrel 105 and the casing. Responsive to moving slips 140, 150 across the annulus, slips 140, 150 may grip the inner diameter of the casing.

More specifically, lower slips 140 may be positioned between lower cone 110 and cap 180. Lower slips 140 may be configured to radially expand or break responsive to lower cone 110 moving below lower slips 140. Responsive to performing an operation to set downhole tool 100, such as operating the setting tool, the forces applied against threads 142 may be sufficient enough to break the threads 142, which may allow lower slips 140 to move. In other embodiments, the lower slips 140 may expand radially lower cone 110 slides under lower slip 140.

Upper slips 150 may be positioned between upper cone 120 and load ring 160. Upper slips 150 may be configured to radially expand responsive to upper cone 120 moving below upper slips 150. Responsive to performing an operation to set downhole tool 100, such as operating the setting tool, the forces applied may allow upper cone 120 to move, and subsequently move upper slips 150.

Load ring 160 may be an upper bound of the elements of positioned on the outer diameter of the mandrel 105. Load ring 160 may operate as a no-go, stopper, etc. configured to limit the movement, towards a proximal end of the frac plug, of the other elements on the outer mandrel 105. Load ring may be also used to transfer the force from the setting tool during operation to the other components of the frac plug, allowing frac plug to engage the casing ID and set inside.

Cap 180 may be positioned on a distal end 102 of downhole tool 100. Cap 180 may be positioned adjacent to lower slips 140, and limit the rotational movement and linear movement of lower slips 140. Cap may include a passageway that extends through the inner diameter of the cap from a proximal end to a distal end of the cap 180. The passageway may allow fluid to flow through the inner diameter of the frac plug.

Flapper 172 may be configured to allow the flow of fluid in one direction. The one direction may usually from distal end of the well to the proximal end of the well, while restricting the flow of fluid in the opposite direction. Flapper 172 may be made of millable material such as plastic, fiber, brass or dissolvable material. In further embodiments, Flapper 172 may be configured to have an open and closed positioned responsive to flowing fluid from a distal end of tool 100 towards a proximal end of tool 100 while the weak point assembly 170 is intact. In embodiments, flapper 172 may be mounted across an inner diameter of downhole tool 100 or on mandrel 105. Flapper 172 may include weak point assembly 170, wherein weak point assembly 170 may be configured to assist in controlling the flow of fluid between a positioned above flapper 172 and a location below flapper 172.

Weak point assembly 170 may include a housing, disc, and shear pin or shear disc, wherein weak point assembly 170 may be any geometric shape. The housing may be configured to be positioned within a passageway in weak point assembly 170. The housing may be a removable component within weak point assembly 170 or may be an integral component. The housing may have a hollow inner diameter extending from a first face of housing to a second face of housing. In embodiments, fluid may be configured to flow through the hollow inner diameter responsive to a disc being removed from the housing. The housing may be configured to temporarily secure the disc and shear pin. The disc may be an object that is configured to be embedded within the housing when weak point assembly 170 is intact. The disc may be configured to move downhole etc. responsive to a pressure differential applied to a shear pin being greater than a pressure threshold. The shear pin may be a device be inserted into the housing and extend through and across the disc. In embodiments, the shear pin may be exposed to shearing forces via pressure applied on the disc, wherein when the shearing forces are greater than a pressure rating of the shear pin then the shear pin may break. Responsive to the breaking, the disc may move from a positioned within the housing to a position outside of the housing.

In embodiments, weak point assembly 170 may be used in a fracturing procedure utilizing fracturing fluid that fractures formation after the well is cemented. In embodiments, a fracturing procedure may be any procedure associated a well after it is cemented and before the well is abandoned, such as a gun misfire, premature setting of the frac plug, formation screen out above the plug, or any other operation that utilize a frac plug that may include or cause increase in the pressure above the weak point value within the frac plug if needed.

Figure 2:
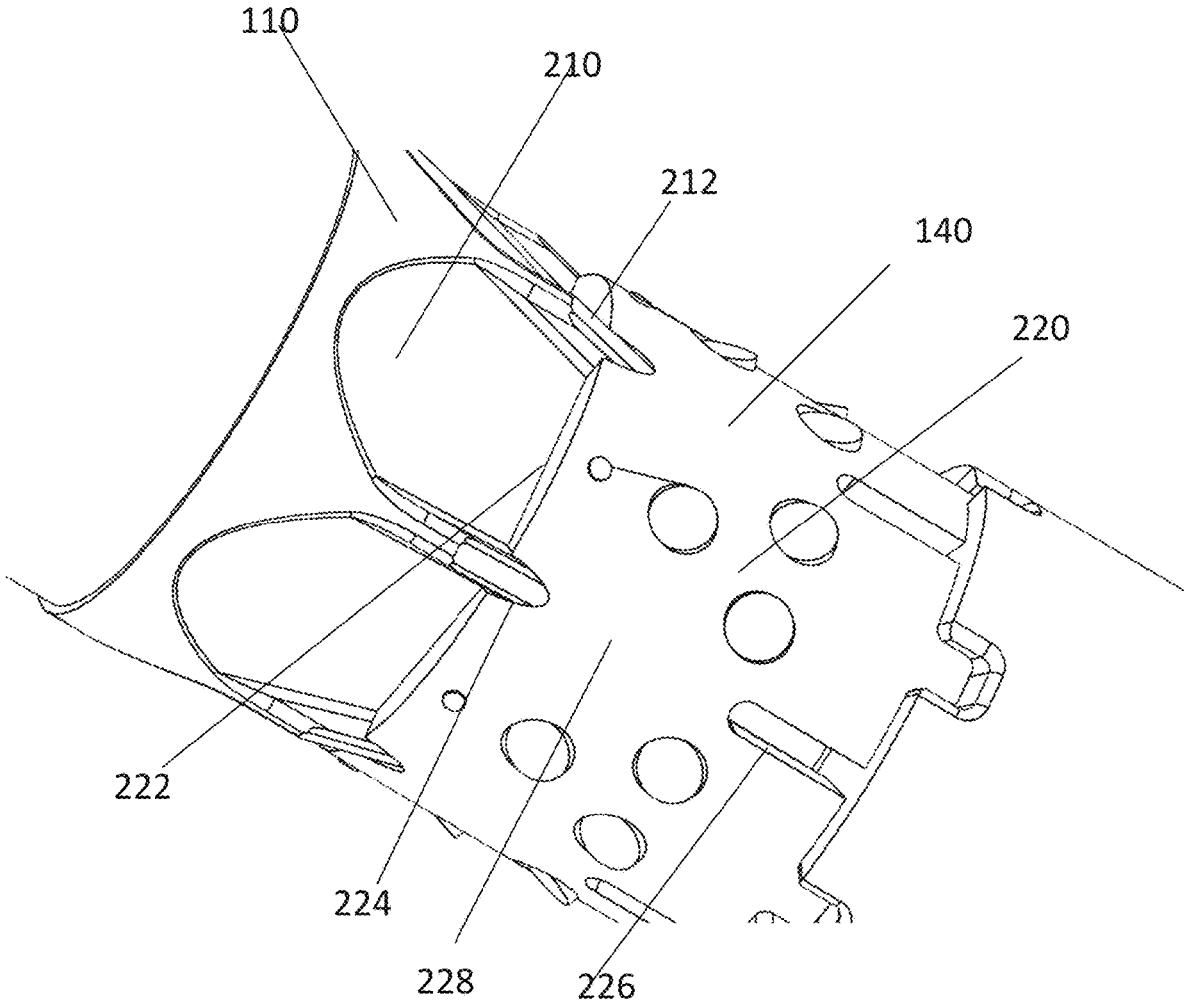
FIG. 2 depicts a perspective view of lower cone and lower slips, according to an embodiment.

FIG. 2 depicts a perspective view of lower cone 110 and lower slips 140, according to an embodiment. Elements depicted in FIG. 2 may be described above, and for the sake of brevity a further description of these elements may be omitted.

As depicted in FIG. 2, lower cone 110 may include a ramp surface 210 and fins 212. Ramp surface 210 may be a sloped outer surface of lower cone 110, and be positioned a pair of fins 212. Ramp surface 210 may be sloped towards a central axis of downhole tool 100. The slope of ramp surface 210 may cause a proximal end of lower cone 110 to be thicker than a distal end of lower cone 110, wherein the slope of ramp surface 210 may be a lower cone ramp angle being between five and thirty degrees. Ramp surface 210 may have a substantially wider length than fins 212.

Fins 212 may be equally spaced around the perimeter of lower cone 110. Fins 212 may be configured to slide within and below upper notch 224 without touching the inner surface of webbing 228. Fins 212 may have a cone bevel angle that is sloped towards the central axis of downhole tool 100. The slope of the cone bevel angle may cause a proximal end of fin 212 to be thicker than a distal end of fin 212. In embodiments, the cone bevel angle may be less than or equal to the lower cone ramp angle. In other embodiments, the cone bevel angle may be slightly larger than the lower cone ramp angle, such as ten percent or degrees larger.

Lower slips 140 may be configured to radially expand based on forces applied by ramp surface 210 interfacing with an inner surface of wedges 220 expand wedges 220. Wedges 220 may be formed between webbings 228, wherein webbings 228 are formed along a longitudinal axis of lower slips 140 between an upper notch 224 and lower notch 226. Responsive to lower slips 140 sliding downward, ramp surface 210 may break lower slips 140 into pairs of wedges 220 due do radial hoop stresses. For example, if you have six wedges 220, the wedges 220 may break into three pairs of wedges 220. In embodiments, single wedges 220 may not be partitioned from all other wedges because fins 212 may not interact directly with an inner surface of webbing 228. This reduces shearing forces being applied to the wedges 220 after a pair of wedges 220 has been disengaged from the other wedges 220

In embodiments, webbings 228 may include a slip inner cut angle, which may be less than or equal to the lower cone ramp angle, and the slip inner cut angle may be substantially equal to the cone bevel angle. In other embodiments, the slip inner cut angle may be slightly larger than the lower cone ramp angle, such as ten percent or degrees larger. The slope of the slip inner cut angle may cause a proximal end webbing 228 to be thinner than a distal end of webbing 228.

In embodiments, the slip inner cut angle, the cone bevel angle, and lower cone ramp angle may all be non-zero angles that extend in the same direction.

Figure 3:
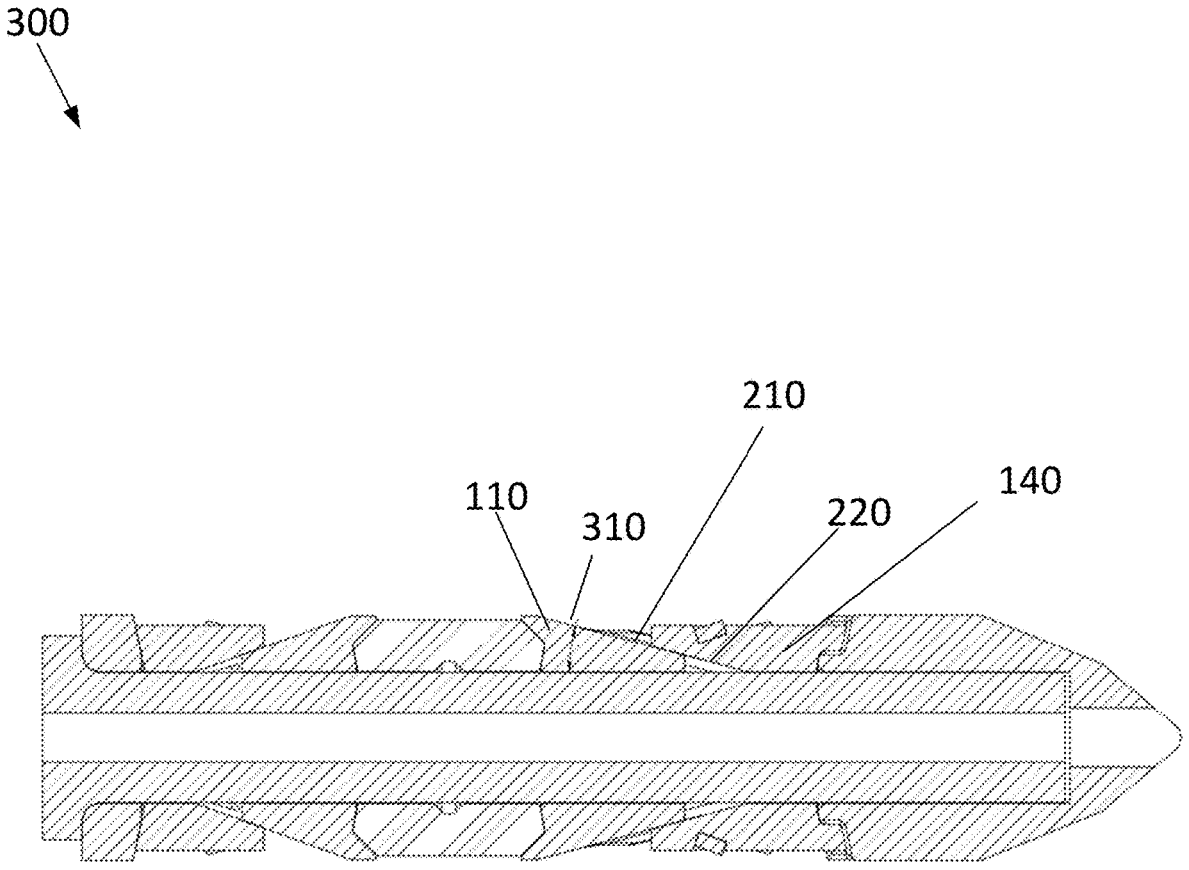
FIG. 3 depicts a first cross sectional view of downhole tool, according to an embodiment.

FIG. 3 depicts a first cross sectional view 300 of downhole tool 100, according to an embodiment. More specifically, the cross sectional view is aligned in a plane where ramp surface 210 intersects with an inner surface of wedge 220. Elements depicted in FIG. 3 may be described above, and for the sake of brevity a further description of these elements may be omitted.

As depicted in FIG. 3, the wedge angle of lower slip 140 may be substantially similar to the lower cone ramp angle 310 of ramp surface 210. This enables ramp surface 210 to slide under wedge 220 to radially expand lower slip 140.

Figure 4:
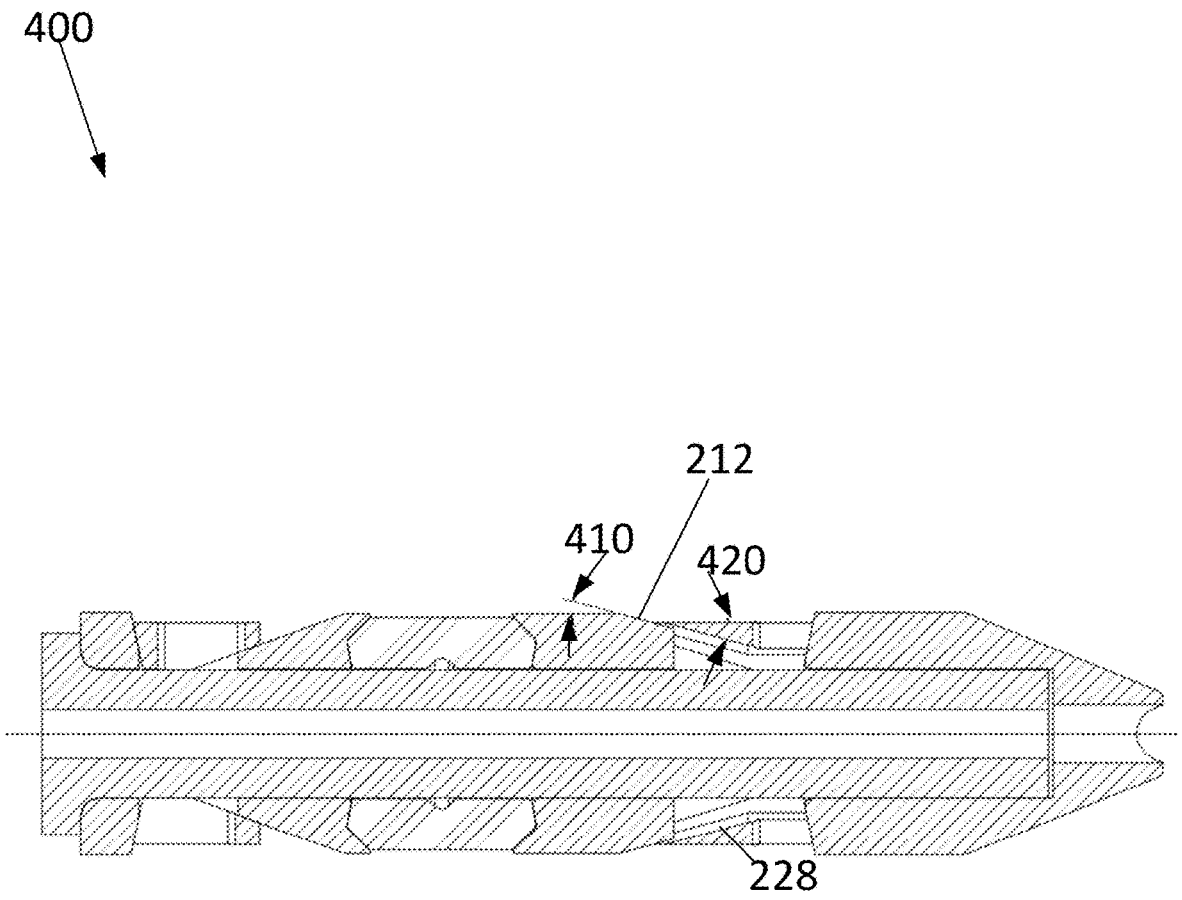
FIG. 4 depicts a second cross sectional view of downhole tool, according to an embodiment.

FIG. 4 depicts a second cross sectional view 400 of downhole tool 100, according to an embodiment. More specifically, the cross sectional view is aligned in a plane where fin 212 intersects with an inner surface of webbing 228. Elements depicted in FIG. 4 may be described above, and for the sake of brevity a further description of these elements may be omitted.

As depicted in FIG. 4, the cone bevel angle 410 of fin 212 may be substantially similar to that of the slip inner cut angle 420 associated with the webbing 228. In embodiments, an outer surface of fin 212 may be offset from the inner surface of webbing 228, at a location away from the outer diameter of mandrel 105. Due the inner cut angle 420 and the cone bevel angle 410 being substantially similar, even as ramp surface 210 interacts with the inner surface of the wedges 220 to radially expand lower slips 140, fin 212 nor any other element of cone 110 may interact and touch the inner surface of webbing 228. This may enable the wedges 228 to not break due to the fins 212 interacting with the webbing 228. However, the wedges 228 may break due to hoop stresses caused by the wedges 228 expanding as they move over the ramp 210 of the cone 110.

Additionally, as depicted in FIG. 4, before being deployed a distal end of fin 212 may be positioned under a proximal end of webbing 228. This may limit the ability of fin 212 to accidently shear an edge of webbing 228. Further, even if there was inadvertent contact between fin 212 and the inner surface of webbing 228, the fin 212 would assist in radially expanding webbing 228 rather than shearing webbing 228.

Also, in embodiments, the outer surface of webbing 228 may extend in a radial plane that is perpendicular to the central the downhole tool 100, and inner cut angle 420 associated with webbing 228 may continually extend until the inner surface of webbing 228 and the outer surface of webbing 228 intersect. Alternatively, the inner cut angle 450 may terminate in a right angle at a plane orthogonal to the central axis of downhole tool 100, which occurs before the natural intersection of the inner cut angle 450 and the outer surface of webbing 228.

Figure 5:
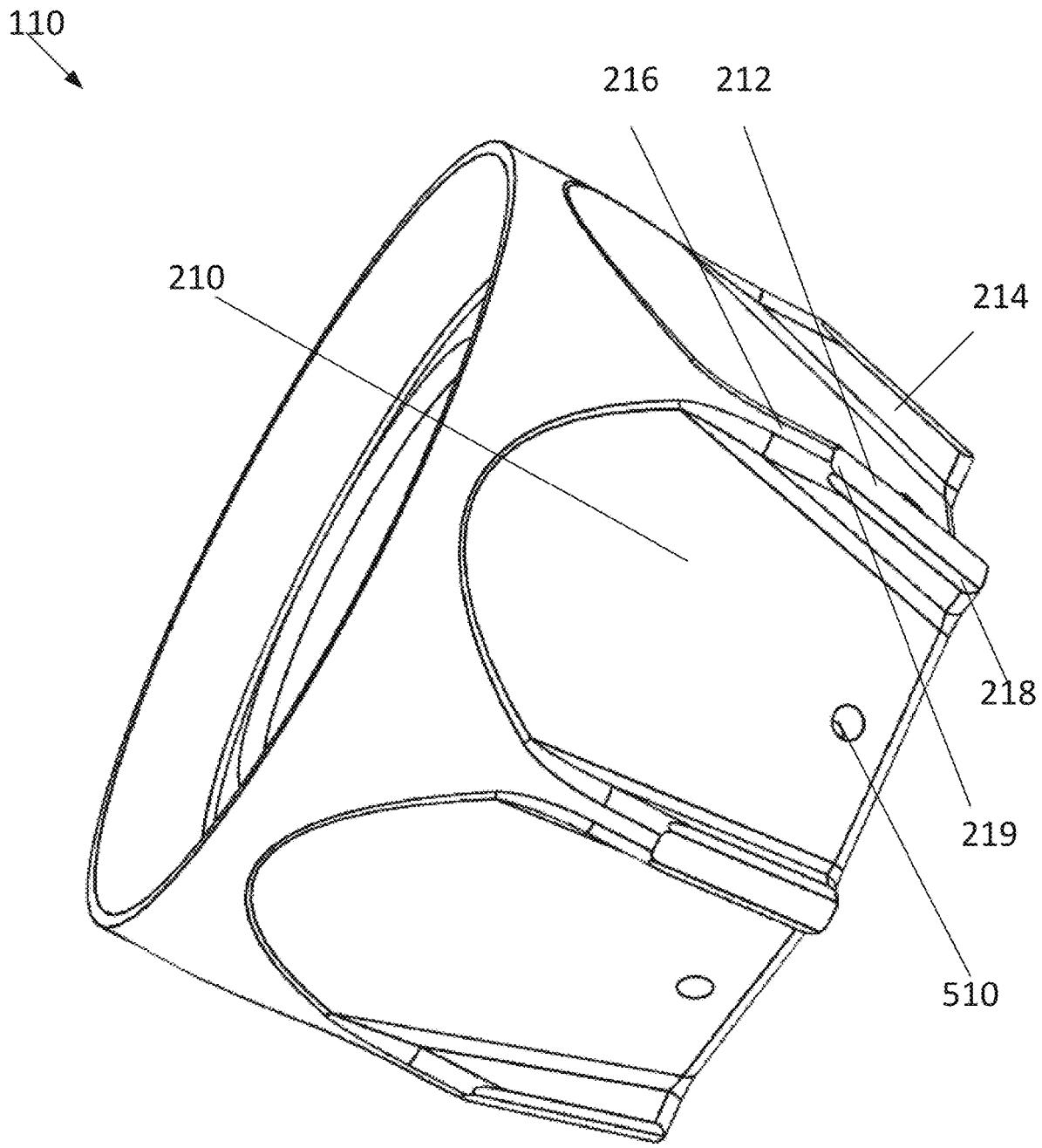
FIG. 5 depicts a lower cone, according to an embodiment.

FIG. 5 depicts a lower cone 110, according to an embodiment. Elements depicts in FIG. 5 may be described above, and for the sake of brevity a further description of these elements may be omitted.

As depicted in FIG. 5, ramp surface 210 and an outer surface of fins 212 may have a similar angle. Furthermore, ramp surface 210 and the outer surface of fins 212 may be radially offset from each other, wherein the outer surface of ramp 210 is radially positioned further away from a central axis of lower cone 110 than the outer surface of fins 212.

As further depicted in FIG. 5, cone 110 may include a coupling orifice 510. Coupling orifice 510 may be configured to receive a pin, threads, or any other coupling mechanism. The coupling mechanism may be configured to be inserted through the coupling orifice 510, which may couple cone 110 with slips 140 and the mandrel. In embodiments, coupling orifice 510 may be positioned on a ramp surface 210 of cone 110, at a location proximate to a distal end of cone 110.

Fins 212 may also include planer sidewalls 214 that extend in parallel to each other. Fins 212 may extend radially away from ramp surface 210. Because planer sidewalls 214 extend in parallel to each other a width across an entire body, or parts of the body, of fins 214 may be substantially equal. Additionally, because the tapering of fins and ramp surface 210 is equal, the upper surface of the distal end 218 of planer sidewalls 214 and ramp surface 210 may have a same radial offset from the upper surface of proximal end 219 of planer sidewalls 214 and ramp surface 210.

In embodiments, fins 212 may also include a tapered proximal end 216 that gradually increases the height of fins 212, wherein tapered proximal ends 216 are positioned between proximal end of 219 of planer sidewalls 214 and a proximal end of cone 110. Furthermore, planer sidewalls 214 may be positioned between tapered proximal ends 214 and the distal end of cone 110.

Figure 6:
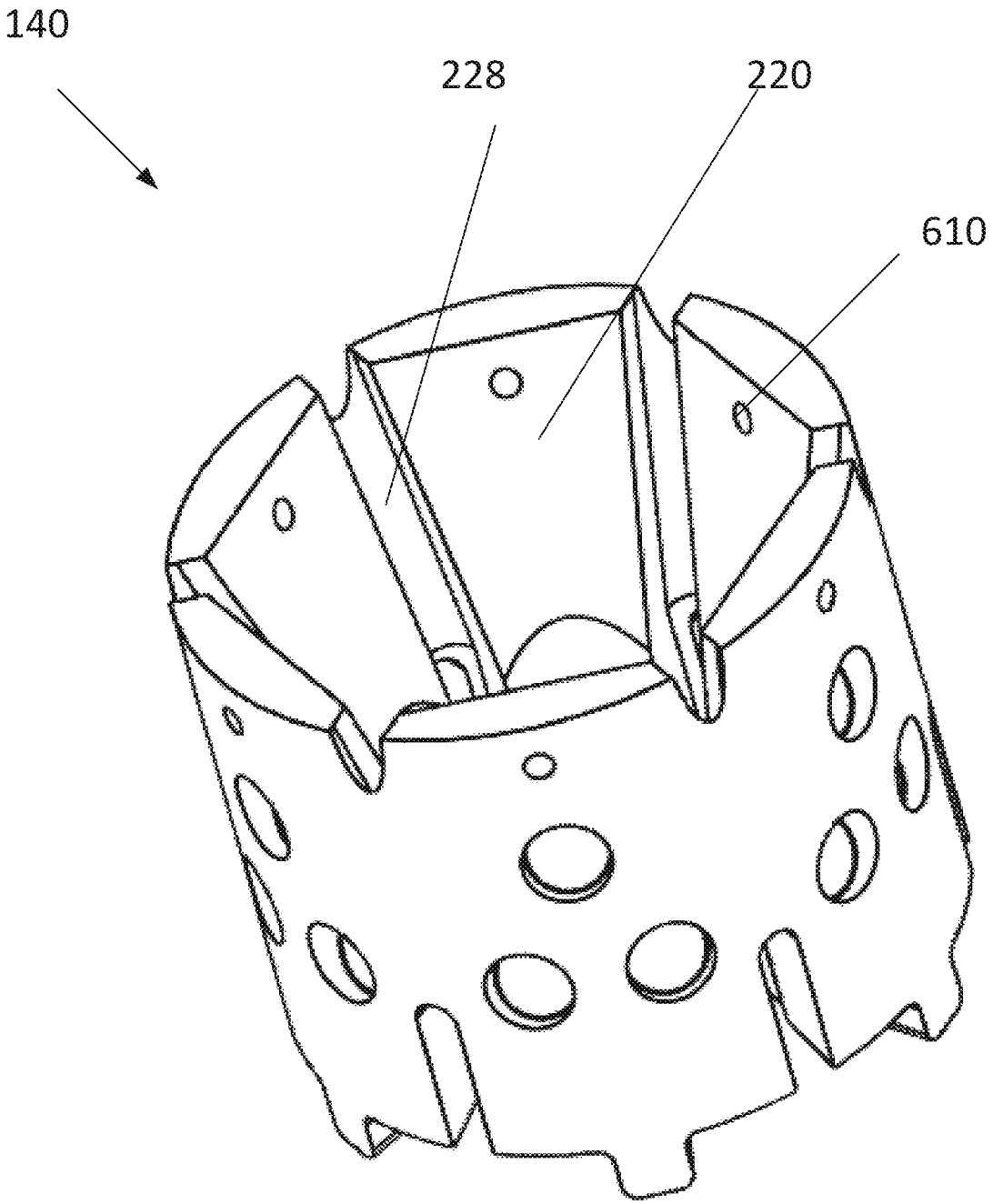
FIG. 6 depicts lower slips, according to an embodiment.

FIG. 6 depicts lower slips 140, according to an embodiment. Elements depicts in FIG. 6 may be described above, and for the sake of brevity a further description of these elements may be omitted.

As depicted in FIG. 6, an inner cut angle of the inner surface of webbing 228 may be similar to that of the inner surfaces of wedges 220. As such, a radial offset between the inner surface of webbing and the inner surfaces of wedges 220 may remain constant, which may enable the outer surface of fins 212 to not directly interact or contact the inner cut angle of webbing 228. By having fins 212 not contact the inner surfaces of lower slips 140, the wedges 220 may not shear and may eventually break off into pairs of wedges 220 that are still connected by webbing 228. To this end, when lower slips 140 have radially expanded and are gripping the inner diameter of casing, pairs of wedges 220 may still be directly connected to each other.

As further depicted in FIG. 6, slips 140 may include a coupling orifice 610. Coupling orifice 610 may be configured to receive a pin, threads, or any other coupling mechanism. The coupling mechanism may be configured to be inserted through the coupling orifice 610 and cone, which may couple cone 110 and slips 140 with the mandrel. In embodiments, coupling orifice 610 may be positioned through wedges 220, at a location proximate to a proximal end of slips 140. To this end, coupling mechanisms in a same radial plane may be utilized to couple slips 140, cone 110, and the mandrel.

Figure 7:
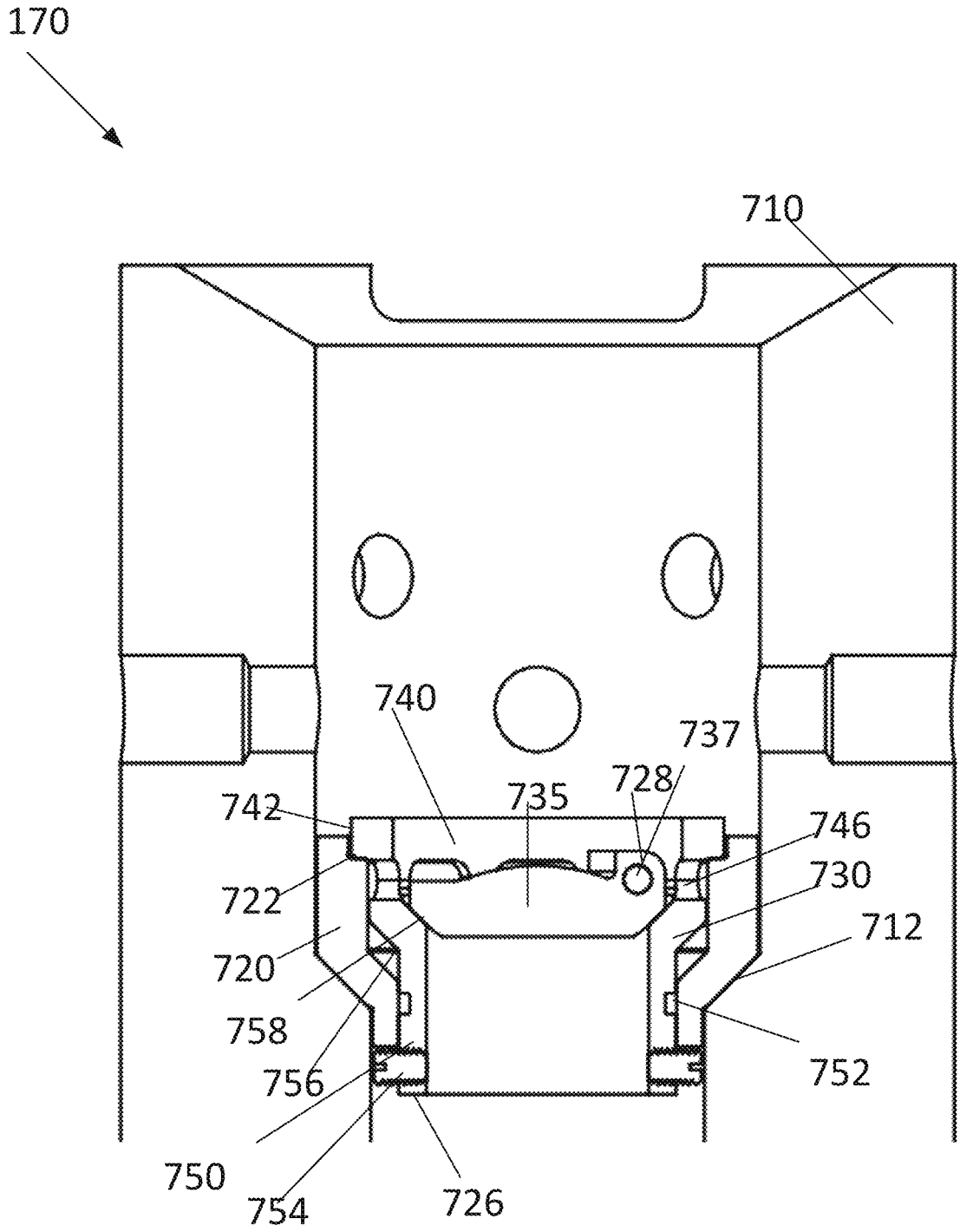
FIG. 7 depicts one embodiment of a weak point assembly, which may be utilized within the downhole tool.

FIG. 7 depicts one embodiment of a weak point assembly 170, which may be utilized within the downhole tool. Weak point assembly 170 may be configured to be position on a mandrel 710, and may include insert 720 and housing 730.

Mandrel 710 may be a shaft, cylindrical, rod, etc. that is configured to form a body of downhole tool 700. Mandrel 710 may include a profile 712 that reduces an inner diameter of mandrel 710 that limits the movement of insert 720 in a first direction. Profile 712 may be a ledge that is perpendicular to a central axis of downhole tool 100 or may be a tapered sidewall that gradually and incrementally decreases the inner diameter of mandrel 710. In other embodiments, there may be no need to have profile 712.

Insert 720 may be a tool formed of composite material, or any desired material. Insert 720 may be configured to be mounted on an inner diameter of mandrel 710 of downhole tool 700. Insert 720 may include ledge 722, sloped sidewall 724, distal end 726, and pin slots 128. Insert 720 may be threaded, glued or pinned or fixed to mandrel 710 using any other method. In other embodiments, insert 720 may be just part of the body 710 or may be removed completely and may be replaced by a profile on body 710.

Ledge 722 may decrease an inner diameter across insert 720, which may be configured to act as a stopper, no-go, etc. to restrict the movement of an upper portion of housing 730 in a first direction, wherein the first direction may be downhole. More specifically, ledge 722 may be configured to receive a projection 742 of upper portion 740 of the housing 730. Responsive to positioning projection 742 of upper portion 740 on ledge 722, movement of housing 730 in the first direction may be restricted when upper portion 740 and lower portion 750 are coupled together. However, when upper portion 740 and lower portion 750 are decoupled, ledge 722 may not restrict the movement of lower portion 750 in the first direction.

Sloped sidewall 724 may be configured to gradually decrease the inner diameter of the insert 720. Sloped sidewall 724 may be configured to receive lower portion 750 of housing 730 to restrict the movement of lower portion 750 in the first direction responsive to decoupling upper portion 740 and lower portion 750. In embodiments, an angle of the sloped sidewall may correspond to the tapered sidewall of mandrel 710. Furthermore, a seal may be formed between an outer diameter of lower portion 750 and an inner diameter of insert 720 when lower portion 750 and upper portion 740 are de-coupled.

The distal end 726 of the insert 720 may project away from an inner diameter of the mandrel 710 to create a lower shelf. Distal end 726 may be configured to interface with elements locking outcrops 754 of lower portion 750 to limit the movement of lower portion 750 in a second direction. In certain embodiments, tool 700 may not include an insert 720 and housing 730 may be directly mounted on mandrel 710, wherein mandrel 710 may have a similar inner profile as that described above.

Pin slots 728 may be holes, slots, indentations, etc. positioned through insert that are configured to selectively receive flapper pin 737. Specifically, pin slots 728 may have a first end that is positioned on the proximal end of insert 720 and extend towards a distal end of insert 720. Pin slots 728 may extend in a linear path with a larger length than that of flapper pin 737, which may allow flapper pin 737 to be free floating within pin slots 728. The proximal end of pin slots 728 may be configured to be contained between the upper portion 740 and lower portion 750 of housing 730 when upper portion 740 and lower portion 750 are coupled together. After flapper pin 737 is disengaged from pin slots 728 it may be unlikely that flapper pin 737 can reengage with pin slots 728 down well.

Housing 730 may be formed of brass, composite, aluminum, cast iron or any other material that can dissolve over time due well fluid and temperature. Housing 730 may be configured to be positioned within insert 720 when run in hole, wherein elements of housing 730 may all be coupled together when run in hole. The housing 730 may include a flapper 735, upper portion 740, and lower portion 750. In other embodiments, the flapper 735 and flapper pin 737 may be replaced by disc or any geometrical shape.

Flapper 735 may be a rotatable disc formed of brass, composite, aluminum, cast iron or any other material that can dissolve over time due well fluid and temperature. Flapper 735 may be configured to rotate from a position blocking an inner diameter of the tool 700 to a position allowing fluid to flow around flapper 735. When flapper 735 extends across an annulus within tool, flapper 735 may be configured to be positioned on a flapper seat 158 within the lower portion of housing 730. When flapper 735 is positioned on flapper seat 158, whether upper portion 740 and lower portion 750 are coupled or decoupled from each other, a first area on a first side of flapper 735 may be isolated from a second area on a second side of flapper 735. Accordingly, flapper 735, lower portion 750, and insert 720 may extend across an inner diameter of mandrel 710 to form a seal across a plane through mandrel 710 to isolate the first area from the second area. However, if flapper 735 is rotated to not extend across the annulus within tool 700 and/or upper portion 740 is not positioned within insert 720, then the first area and second area may not be isolated from each other. Flapper 735 may be a free floating component that is mounted inside the housing 730 via a flapper pin 737 and insert 720. Flapper 735 may be configured to apply forces when pressure or forces are applied to flapper 735 from above against stress points 746 within housing 130 to separate upper portion 740 and lower portion 750 of housing.

Flapper pin 737 may be a free floating, which enables flapper 735 to move along a linear axis confined by pin slots 728. Flapper pin 737 configured to extend across an entirety of the diameter of housing and have ends that are configured to be inserted into pin slots 728. When flapper pin 737 is inserted into the pin slots 728, flapper 735 may be couple housing 730 and insert 720. In embodiments, flapper pin 737 may be an integral portion of flapper 735 or may be removably coupled to flapper 735, such that flapper pin 737 may slide out of flapper 735.

Upper portion 740 of housing 730 may be configured to be selectively coupled to lower portion 750 of housing 730 based on a pressure applied across housing 730 and a direction of fluid flowing within tool 700, wherein both upper portion 740 and lower portion 750 are positioned within an inner diameter of mandrel 710 when run in hole. Upper portion 140 may include projection 742 and stress points 746. In other embodiments, upper portion 740 and lower portion 750 may be two elements connected together via stress points 746 which can be a shear screw.

Projection 742 may be positioned on a proximal end of upper portion 740 and project away from a central axis of housing 730 to increase an outer diameter of upper portion 740. Projection 742 may be configured to slide onto and sit on ledge 722. Responsive to positioning projection 742 on ledge 722, movement of upper portion 740 in the first direction may be limited.

Stress points 746 may be positioned between upper portion 740 and lower portion 750 of housing 730. Stress points 746 may be weak points where upper portion 740 becomes disconnected from lower portion 750, wherein stress points 746 extend in parallel to a central axis of mandrel 710, wherein stress points 746 are not coupled to mandrel 710, insert 720 or flapper 735. In embodiments, stress points 746 may be configured to receive a force from flapper 735 against flapper seat 758 responsive to moving the free floating flapper 735 to be positioned on flapper seat 758. More specifically, when fluid is flowing through the inner diameter of tool 700, flapper 735 may receive forces created by the flowing fluid/pressure. This may allow flapper 735 to seat on the lower portion 750 of the housing 730, and cause flapper 735 to apply a pressure against the stress points 746. When flapper 735 applies a pressure greater than a stress threshold of stress points 746, stress points 746 may break causing upper portion 740 and lower portion 750 to become detached and separated. Then, lower portion 750 of housing may move in the first direction towards the distal end of the housing 730 with the flapper 735 and flapper pin 737.

Lower portion 750 of housing 730 may be configured to be selectively coupled to upper portion 740 of housing 730. Lower portion 750 may include seal 752, locking outcrops 754, and tapered sidewall 756. Seal 752 may be configured to be positioned between an outer diameter of the lower portion 750 and an inner diameter of inset 720. Seal 752 may not allow communication through a gap between insert 720 and housing 730 when lower portion 750 is still connected to the upper portion 750 of the housing 730, and when flapper 735 is positioned on flapper seat 758. Locking outcrops 754 may be positioned on the distal end of lower portion 750 below the distal end 726 of insert 720.

Locking outcrops 754 may increase an outer diameter of the lower portion 750 such that a diameter of locking outcrops 754 is larger than that of distal end 726. Due to locking outcrops 754 being larger in size than that of the outer diameter of the distal end 726 and internal diameter of the lower end of insert 720, locking outcrops 754 may restrict the movement of lower portion 750 in a second direction relative to insert 720, wherein the second direction is an opposite position from the first direction. This may assist in the disengaging the upper portion 740, flapper 735 and flapper pin 737 from the lower portion 740 when there is a flow back through tool 700. Further, by restricting lower portion 750 from moving in the second direction using locking outcrops 754 and the first direction using ledge 722, the lower portion 750 can be milled with the frac plug as an integral piece. Hence facilitating milling operation if needed.

Tapered sidewall 756 may be a slanted sidewall that is configured to be positioned on slanted sidewall 724 of insert 720 after lower portion 750 is sheared from upper portion 740.

Flapper seat 758 may be positioned between stress points 746 and locking outcrops 754. Flapper seat 758 may be configured to reduce the inner diameter across lower portion 750, such that flapper 735 may be positioned on flapper seat 758. Responsive to flapper 735 receiving pressure above the flapper 735 in the first direction, flapper 735 may translate these forces to lower portion 730 through flapper seat 758, which may shear stress points 746.

In embodiments, upper portion 740 and lower portion 750 of housing may be coupled together via stress points 746 within the inner diameter of mandrel 110. As such, upper portion 740, lower portion 750, and stress points 746 may be positioned within a same vertical plane extending through the inner diameter of mandrel 710. This may enable upper portion 740 and lower portion 750 to be sheared along a plane that extends in parallel to a central axis of the mandrel 710. In other embodiments, the upper portion 740 and lower portion 730 can be two separate pieces coupled together with stress point 745

After the shearing of upper portion 740 from lower portion 730, flapper 735 may still be encompassed by upper portion 740 and lower portion 730 until fluid is flowed in an opposite direction that used to shear upper portion 740 from lower portion 730.

Reference throughout this specification to "one embodiment", "an embodiment", "one example" or "an example" means that a particular feature, structure or characteristic described in connection with the embodiment or example is included in at least one embodiment of the present invention. Thus, appearances of the phrases "in one embodiment", "in an embodiment", "one example" or "an example" in various places throughout this specification are not necessarily all referring to the same embodiment or example. Furthermore, the particular features, structures or characteristics may be combined in any suitable combinations and/or sub-combinations in one or more embodiments or examples. In addition, it is appreciated that the figures provided herewith are for explanation purposes to persons ordinarily skilled in the art and that the drawings are not necessarily drawn to scale.

Although the present technology has been described in detail for the purpose of illustration based on what is currently considered to be the most practical and preferred implementations, it is to be understood that such detail is solely for that purpose and that the technology is not limited to the disclosed implementations, but, on the contrary, is intended to cover modifications and equivalent arrangements that are within the spirit and scope of the appended claims. For example, it is to be understood that the present technology contemplates that, to the extent possible, one or more features of any implementation can be combined with one or more features of any other implementation.

What is claimed is:

1. A downhole tool comprising:

a slip with a plurality of wedges and webbing, the webbing being positioned between the plurality of wedges, wherein after setting the slip at least a fin of a cone is configured to be radially positioned between an inner surface of the webbing and a central axis of the downhole tool without contacting an inner surface of the webbing, the fin extending outward from an outer surface of the cone.

2. The downhole tool of claim 1, wherein the webbing does not break as the slip radially expands.

3. The downhole tool of claim 1, wherein the upper surface of the cone does not contact the inner surface of the webbing as the slip and cone move relatively toward each other.

4. The downhole tool of claim 1, wherein the slip is formed of a single unitary piece.

5. The downhole tool of claim 1, wherein the webbing and the slip have flushed external surfaces.

6. The downhole tool of claim 1, wherein the slip includes a distal notch and a proximal notch, the distal notch extending from an inner surface of the slip to an outer surface of the slip in a radial direction, the proximal notch extending from the inner surface of the slip to the outer surface of the slip in the radial direction, wherein the distal notch, the webbing, and the proximal notch are aligned.

7. The downhole tool of claim 6, wherein the proximal notch is shorter than the distal notch.

8. The downhole tool of claim 6, wherein before activating the slip the proximal notch is positioned closer to the fin of the cone than the distal notch.

9. The downhole tool of claim 1, wherein a first distance from an uphole end of the slip to an uphole end of the webbing is shorter than a second distance from a downhole end of the slip to a downhole end of the webbing.

10. The downhole tool of claim 1, wherein an outer end of the fin does not contact the slip.

11. The downhole tool of claim 10, sidewalls of the fin contact the inner surface of the webbing as the slip is being activated.

12. The downhole tool of claim 11, wherein the upper surface of the fin is partially positioned between the inner surface of the webbing and the central axis of the downhole tool before the slip is activated.

13. The downhole tool of claim 11, wherein a width of the upper surface of a first portion of the fin remains constant.

14. The downhole tool of claim 13, wherein the first portion of the fin extends to a downhole end of the cone.

15. The downhole tool of claim 14, wherein a ramp angle of the slip is substantially equal to a fin angle of the fin.

16. The downhole tool of claim 1, wherein the slip is a first symmetrical object, and the cone is a second symmetrical object.

17. The downhole tool of claim 1, wherein before setting the slip at least the portion of the cone is not positioned radially between an inner surface of the webbing and a central axis of the downhole tool.

18. A downhole tool comprising:

a slip with a plurality of wedges and webbing, the webbing being positioned between the plurality of wedges, wherein after setting the slip at least a portion of a cone is configured to be positioned radially between an inner surface of the webbing and a central axis of the downhole tool without contacting an inner surface of the webbing, wherein before setting the slip at least the portion of the cone is positioned radially between an inner surface of the webbing and a central axis of the downhole tool without contacting an inner surface of the webbing.

19. A downhole tool comprising:

a slip with a plurality of wedges and webbing, the webbing being positioned between the plurality of wedges, wherein after setting the slip at least a portion of a cone is configured to be positioned radially between an inner surface of the webbing and a central axis of the downhole tool without contacting an inner surface of the webbing, a cap positioned downhole from the slip, wherein the cap and the slip include anti-rotation mechanisms that do not allow the relative rotation between the cap and the slip.

* * * * *